US008453366B2

(12) United States Patent
Gray

(10) Patent No.: US 8,453,366 B2
(45) Date of Patent: Jun. 4, 2013

(54) MAGAZINE LOADER

(76) Inventor: Russell E Gray, Duluth, GA (US)

( * ) Notice: Subject to any disclaimer, the term of this patent is extended or adjusted under 35 U.S.C. 154(b) by 95 days.

(21) Appl. No.: 13/234,283

(22) Filed: Sep. 16, 2011

(65) Prior Publication Data

US 2013/0067788 A1 Mar. 21, 2013

(51) Int. Cl.
*F41A 9/82* (2006.01)

(52) U.S. Cl.
USPC ..... 42/88; 42/87; 86/47

(58) Field of Classification Search
USPC ..... 42/87, 88; 86/47
See application file for complete search history.

(56) References Cited

U.S. PATENT DOCUMENTS

| | | | | | |
|---|---|---|---|---|---|
| 1,295,039 | A | * | 2/1919 | Johnson | 86/47 |
| 2,394,033 | A | * | 2/1946 | Wossum | 86/47 |
| 2,451,521 | A | * | 10/1948 | Uglum | 86/47 |
| 4,425,834 | A | * | 1/1984 | Lohmann | 89/1.11 |
| 4,706,402 | A | * | 11/1987 | Csongor | 42/87 |
| 4,739,572 | A | * | 4/1988 | Brandenburg | 42/87 |
| 4,879,829 | A | * | 11/1989 | Miller et al. | 42/87 |
| 4,949,495 | A | * | 8/1990 | Mari | 42/87 |
| 5,301,449 | A | * | 4/1994 | Jackson | 42/87 |

* cited by examiner

*Primary Examiner* — Gabriel Klein
(74) *Attorney, Agent, or Firm* — Woodcock Washburn LLP

(57) ABSTRACT

A magazine loader is disclosed that facilitates the rapid loading of firearms magazines. A loader, as disclosed, can receive magazines and ammunition and, by means of manipulation of a handle or shaft, a gear within the loader may motivate a plate to push ammunition into a magazine. Ammunition may be pushed into the magazine until the magazine is filled to capacity. Once filled, the magazine may be ejected from the loader by operation of the plate. Ammunition and magazines may be oriented in any manner and several magazines may be loaded at once.

20 Claims, 6 Drawing Sheets

MAGAZINE LOADER

TECHNICAL FIELD

The technical field generally relates to firearm magazine loaders.

BACKGROUND

Many modern firearms, and the bulk of those in use by the military, use a magazine to hold and feed ammunition into the firearm. Such magazines may be configured to hold any number of cartridges. Currently, such magazines are usually loaded by hand. While some devices exist that make it easier for a user to load an individual cartridge into a magazine, it is still time consuming to load magazines, which may have a capacity of 30 or more rounds of ammunition. In a battlefield setting, or during any other type of conflict where large amounts of ammunition may be needed, this time consuming task of loading magazines is, at a minimum, a distraction and, in many situations, could be dangerous or even deadly for those involved in the conflict. Moreover, if a person involved in a conflict is injured in such a way that loading a magazine by hand is very difficult or impossible, the inability to load a magazine may render the person unable able to defend himself or herself, potentially resulting in death. It is likely to take longer than normal in a conflict setting to hand-load magazines due to the distraction and stress of the ongoing conflict occurring around the user loading the magazines. Such conditions are also likely to increase mistakes while loading. Time spent loading magazines in a conflict setting is better spent engaged in the conflict. Therefore, what is needed in the art is a device that can load magazines quickly and is portable and simple to operate, maintain and manufacture.

SUMMARY

A magazine loader is disclosed that may include a case, a handle affixed to a shaft that extends through a side of the case, a gear affixed to the shaft, a plate in a first position movably connected to the gear such that rotational motion of the gear linearly motivates the plate, and a base comprising an ammunition section proximate to the plate and a magazine section proximate to the ammunition section, wherein when the plate is motivated towards the ammunition section to a second position, the plate may push ammunition in the ammunition section into a magazine in the magazine section. The handle may be constructed for manipulation by a human user. Alternatively, the shaft and/or gear may be motivated by a mechanical means, an electrical means, or a combination thereof.

In an embodiment, the plate may be motivated towards the ammunition section to the second position by manipulation of the handle, shaft and/or gear in a first direction. The plate may also motivated away from the ammunition section to the first position by manipulation of the handle, shaft and/or gear in a second direction, permitting more ammunition to enter the ammunition section. The magazine loader case or housing may include openings for the insertion of a plurality of magazines, a plurality of units of ammunition, and/or ejection of one or more loaded magazines.

In an embodiment, when the plate pushes the ammunition into a magazine, the ammunition is removed from a clip. When pushing ammunition into the magazine, the plate may extend into the interior of the magazine. When pushing ammunition into the magazine such that the magazine becomes filled to capacity, the plate may push the magazine toward an opening in the case, in an embodiment ejecting the magazine through the opening in the case. Upon ejection or manual removal of the fully loaded magazine, the plate may be motivated away from the ammunition section to the first position by manipulation of the handle, shaft and/or gear in a second direction, permitting more ammunition to enter the ammunition section and another magazine to enter the magazine section.

In an embodiment, the gear may have teeth that engage openings in the plate. Alternatively, the plate may have teeth that engage openings in the gear. A base of the loader may include one or more gears that engage a bottom of the plate in order to keep the plate properly oriented during the loading process.

In an embodiment, the magazine and the ammunition may be horizontally oriented, while in another embodiment, the magazine and the ammunition may be vertically oriented. These and other aspects of the present disclosure are described in more detail herein.

BRIEF DESCRIPTION OF THE DRAWINGS

The following detailed description of various embodiments is better understood when read in conjunction with the appended drawings. For the purposes of illustration, there is shown in the drawings exemplary embodiments; however, the subject matter is not limited to the specific elements and instrumentalities disclosed. In the drawings.

DETAILED DESCRIPTION OF ILLUSTRATIVE EMBODIMENTS

In a typical military or law enforcement environment, ammunition is provided in bulk in the form of metal boxes, or "cans", of ammunition usually containing several hundred cartridges. Often this ammunition is packaged within the can as small groups of cartridges (e.g., ten rounds) attached to a small piece of metal or plastic that is configured to affix to the bottom of each cartridge and hold the cartridge in place on the piece of metal or plastic. Such pieces are commonly known as "clips". Clips designed to be easily removed may be referred to as "stripper clips". In hand loading a magazine, a user would remove the cartridges from the clip before or while loading the cartridge into the magazine. As will be appreciated, regardless of whether the clip is designed to be easily removed or not, this loading process is time consuming.

Figure 1:
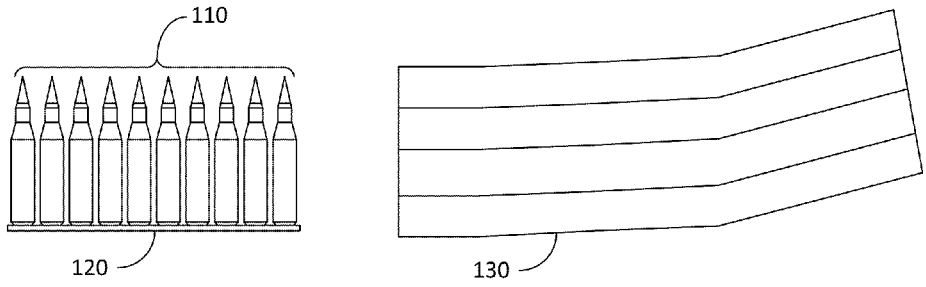
FIG. 1 illustrates exemplary ammunition and an exemplary magazine.

FIG. 1 illustrates an example of ten cartridges 110 affixed to clip 120. Each of cartridges 110 may be any type of cartridge and may include any type of bullet, primer, propellant, and case. Magazine 130 may be configured to accept and hold one or more of each of cartridges 110. Magazine 130 may hold any number of rounds of any type of ammunition. In an exemplary embodiment, each of cartridges 110 may be a 5.56×45 mm NATO rifle cartridge, and magazine 130 may be configured to accept up to 30 of such cartridges. However, appropriately configured, a device according to the present disclosure may be used with any type of ammunition and magazine, and all such embodiments are contemplated as within the scope of the present disclosure.

Figure 2:
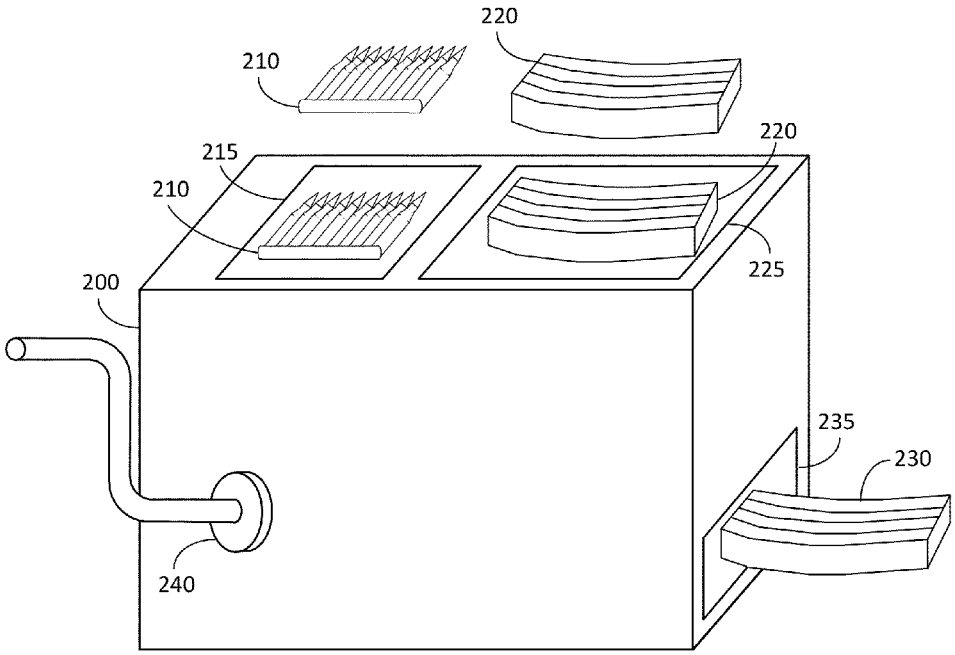
FIG. 2 illustrates an exemplary magazine loader.

FIG. 2 illustrates an exemplary loader 200 according to some embodiments disclosed herein. Loader 200 may accept multiple rounds of ammunition configured on clips (ammunition 210) that may be any type and size of ammunition that may be affixed to a clip (e.g., cartridges 110), loose, or otherwise arranged. Loader 200 may accept one or more magazines 220 of any type (e.g., magazine 130). Loader 200 may have opening 215 for accepting ammunition 210 into loader 200 for loading into magazines 220. Loader 200 may have opening 225 for accepting magazines 220 for loading with ammunition 210 by loader 200. Opening 235 may be configured on loader 200 for removing, releasing, or ejecting loaded magazines 230.

Loader 200 may have handle 240 for actuating the mechanisms inside loader 200. Handle 240 may be manipulated manually by a human operator to cause the mechanisms inside loader 200 to insert ammunition 210 into magazines 220. Handle 240 may be user-removable and may be constructed to fit inside of loader 200 when loader 200 is not in use. Alternatively, handle 240, or some equivalent physical connection to the mechanisms inside loader 200, may be operated by a mechanical device, an electrical device, or a combination thereof. In another alternative, loader 200 may be operated by a mechanical device, an electrical device, or a combination thereof without the use of handle 240, which, in such embodiments, may not be configured on loader 200. In an embodiment, any clips affixed to ammunition 210 may be removed by the mechanisms inside loader 200.

Loader 200 may be configured to accept ammunition 210 and magazines 220 in horizontal orientation (as seen in FIG. 2), vertical orientation, or any other orientation. Moreover, the orientation of ammunition 210 when inserted into loader 200 may differ from the orientation of magazines 220 when inserted into loader 200. All such configurations are contemplated as within the scope of the present disclosure.

Figure 3:
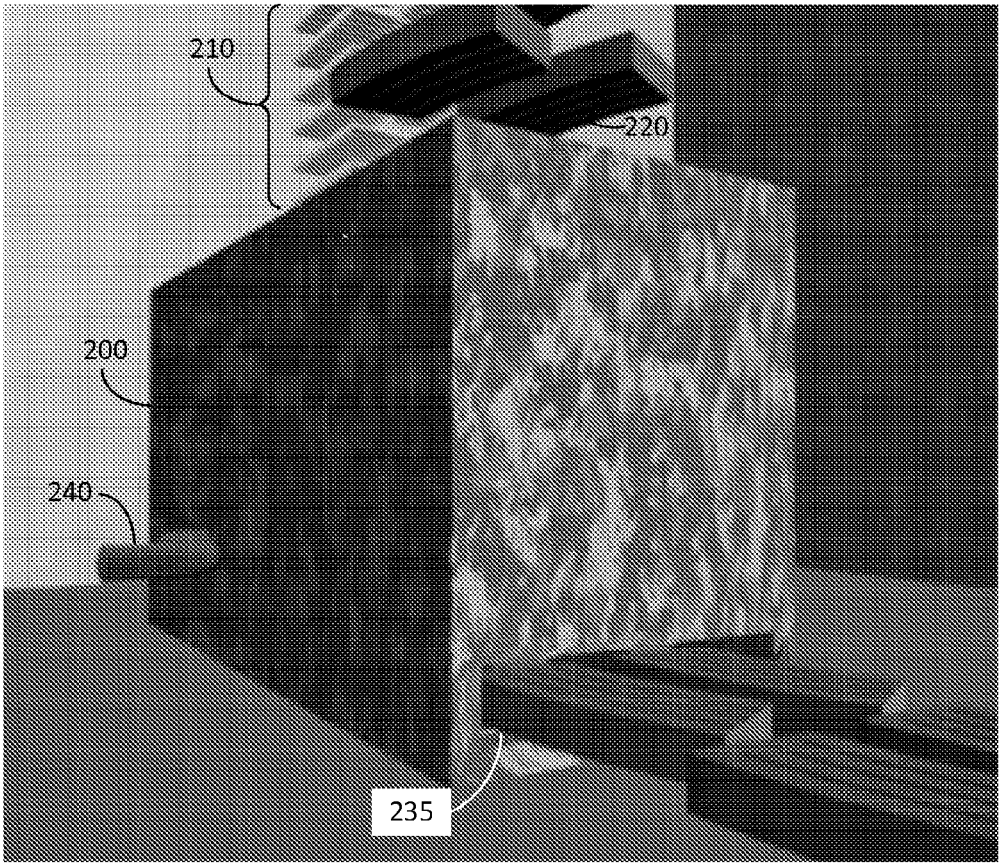
FIG. 3 illustrates another exemplary magazine loader.

FIG. 3 shows another perspective of loader 200. Handle 240, ammunition 210, magazines 220, loaded magazines 230, and opening 235 are visible in FIG. 3. All other elements described in FIG. 2 and any other figure in the present disclosure may also be present in loader 200 of FIG. 3.

Figure 4:
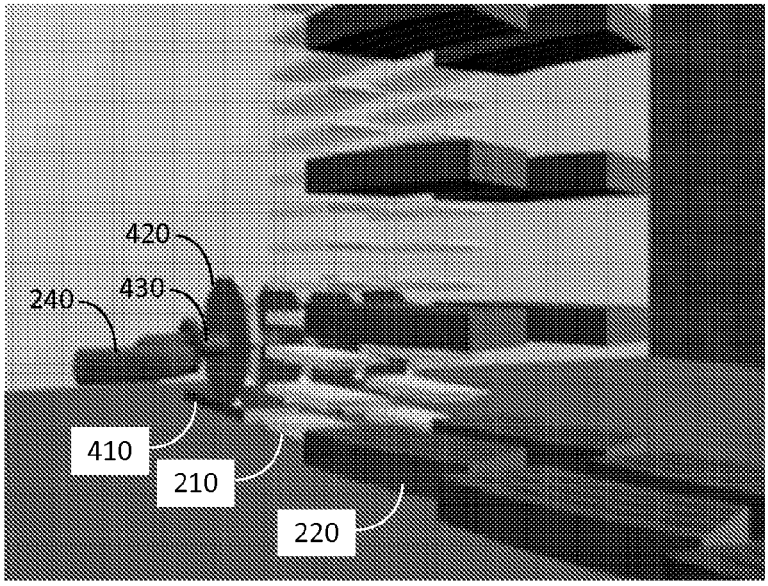
FIG. 4 is a perspective view of an exemplary internal mechanism of an exemplary magazine loader.

FIG. 4 shows loader 200 without a case (unlike in FIGS. 2 and 3) and exposing the internal mechanisms of loader 200. In an embodiment, one or more clips of ammunition 210 may inserted into loader 200. Note that more than one clip of ammunition 210 may be inserted into loader 200 in many embodiments, while other embodiments may allow for only one clip of ammunition 210 to be inserted into loader 200 at one time. The clip of ammunition 210 that is on the bottom of a stack of ammunition may oriented in front of plate 410 that may be movable affixed inside of loader 200. Plate 410 may be a single component or any combination of any number of components. Magazines 220 may be oriented within loader 200 so that the open end of the magazine of magazines 220 that is on the bottom of a stack of magazines 220 is facing a clip of ammunition 210 and is oriented to receive ammunition 210.

Plate 410 may be motivated within loader 200 by gear 420. Gear 420 may be affixed to shaft 430 that may be affixed, directly or indirectly, to handle 240. Shaft 430 may be held in place by the case of loader 200 and/or additional means of affixing shaft 430 within loader 200. Gear 420 may be connected to plate 410 using any means that allows gear 420 to exert force on plate 410 such that plate 410 may be moved towards and away from magazines 220. In one embodiment, gear 420 may have teeth that are inserted into grooves or holes on plate 410 that are aligned with the teeth of gear 420. Alternatively, plate 410 may be constructed with teeth that engage grooves or holes on gear 420. In another embodiment, both gear 420 and plate 410 may have teeth that interconnect. Other means of translating the movement of gear 420 to plate 410, or otherwise motivating plate 410 through the manipulation of handle 240, may be used, and all such means are contemplated as within the scope of the present disclosure.

In an embodiment, when handle 240 is turned, in this example counter-clockwise according to the perspective of FIG. 4, gear 420 via shaft 430 is also turned counter-clockwise and the connection between gear 420 and plate 410 causes plate 410 to be motivated towards ammunition 210. Plate 410 may be positioned such that when it is motivated towards magazine 220, it fully inserts all of the cartridges of ammunition 210 into magazine 220. Note that any clip attached to ammunition 210 may be removed during this insertion by the force of inserting ammunition 210 into magazine 220. In a typical embodiment, magazine 220 may be configured to accept cartridges of ammunition 210, but the opening through which such cartridges are to be inserted may not be large enough to accept a clip affixed to such cartridges. Therefore, in an embodiment, due to the design of magazine 220 and/or the clip of ammunition 210, as the cartridges of ammunition 210 are inserted into magazine 220, the clip of ammunition 210 is stripped off of the cartridges of ammunition 210. Loader 200 may be configured such that clips stripped off of ammunition 210 may fall or be otherwise displaced through an opening in the bottom or side of loader 200. Alternatively, ammunition 210 may not have clips, or such clips may be removed prior to insertion into loader 200 using any other means. In other embodiments, other means may be used within loader 200 to remove any clips attached to cartridges of ammunition 210. All such means are contemplated as within the scope of the present disclosure.

In an embodiment, such as that shown in FIG. 4, more than one gear 420 may be affixed to shaft 430 and connected to plate 410. While in the example embodiment of FIG. 4 two gears are used to motivate each of two plates 410, embodiments are contemplated that use a single gear per plate, or more than two gears per plate. Note also that while the example embodiment of FIG. 4 uses a single plate per magazine to be loaded, one plate may be used to load two or more magazines. In such an embodiment, the single plate may have two or more protrusions that each insert ammunition into a magazine. Such embodiments may use any number of gears for motivating the single plate. All such embodiments and any variations thereof are contemplated as within the scope of the present disclosure.

Figure 5:
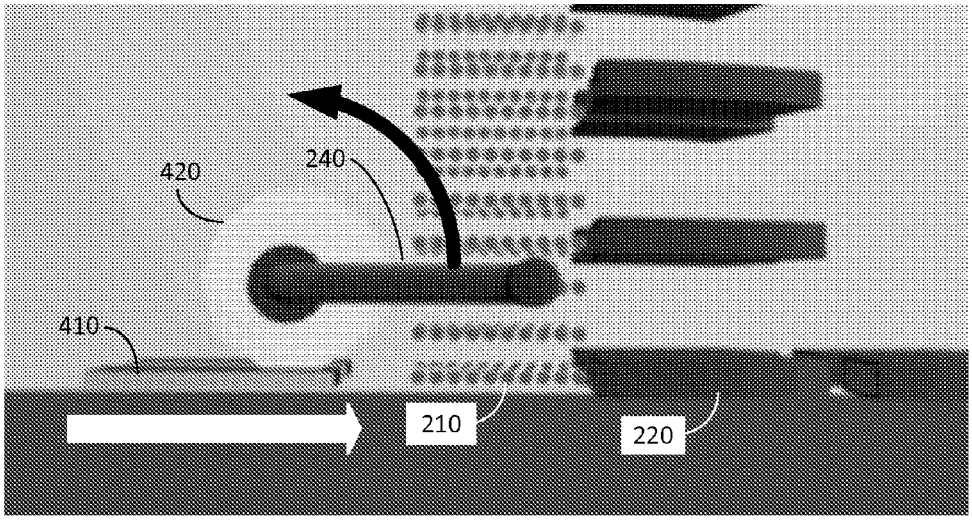
FIG. 5 is a side view of an exemplary internal mechanism of an exemplary magazine loader.

FIG. 5 illustrates a side view of loader 200. When handle 240 is motivated counter-clockwise (in the embodiment and perspective of FIG. 5), gear 420 is also motivated counter-clockwise. Because gear 420 is connected to plate 410 in a manner such that the motion of gear 420 is translated to plate 410, when gear 420 is moved counter-clockwise (from the perspective of FIG. 5 and in this embodiment), plate 410 is motivated towards ammunition 210. Ammunition 210 may be urged or otherwise inserted by plate 410 into magazine 220. After handle 240 has been turned and all of the cartridges of ammunition 210 that have been inserted by plate 410 into magazine 220 are fully inserted into magazine 220, handle 240 may be rotated clockwise, thereby causing gear 420 to pull plate 410 away from magazine 220. Note that the range of rotation of handle 240 may be dependent upon the dimensions of gear 420 and that in some embodiments a stop may be configured in loader 200 to prevent handle 240 from overtraveling beyond designed limits and/or from damaging one or more mechanical components of loader 200. This creates a cavity below a stack of ammunition 210 where the clip of ammunition 210 that has just been inserted into magazine 220 once sat. Due to gravity or other applied force, the stack of ammunition 210 may then fall down into the cavity, and a new clip of ammunition 210 may be positioned for insertion into magazine 220.

Magazines 220 may have a limited capacity that may be a multiple of the number of cartridges affixed to each clip of ammunition 210. For example, many magazines used by the military hold 30 rounds of ammunition, and the ammunition for such magazines is typically provided as ten-round clips. Therefore, when three clips have been inserted into such a magazine, the magazine is filled to capacity. In an embodiment, plate 410 is constructed and configured such that it extends into magazine 220 farther than is required to merely insert ammunition 210 into magazine 220. When the cartridges of the final clip of ammunition 210 required to fill magazine 220 have been inserted into magazine 220 in loader 200, plate 410 will be unable to extend into magazine 220. Therefore, rather than extending into magazine 220, plate 410 may propel magazine 220 out of loader 200, ejecting magazine 220 out of opening 235. Alternatively, plate 410 may propel magazine 220 into a position to allow ease of removal by hand. In another alternative, plate 410 may propel magazine 220 into a position for further manipulation and/or removal from loader 200 by other devices, means, or components. All such embodiments are contemplated as within the scope of the present disclosure.

Figure 6:
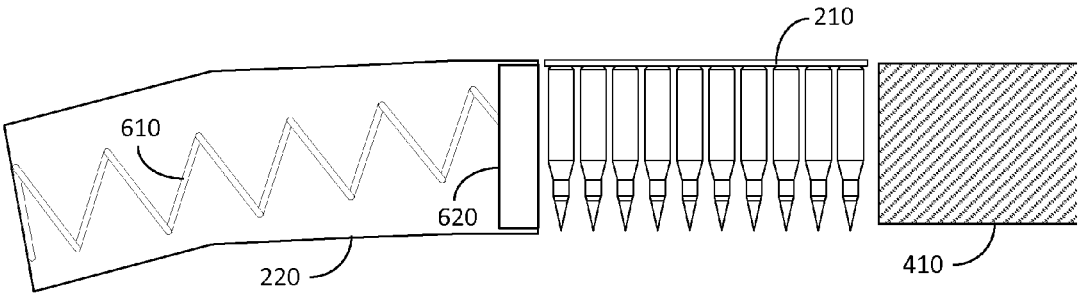
FIG. 6 is a top view of a magazine, ammunition, and a partial exemplary internal mechanism of an exemplary magazine loader.

FIGS. 6-9 illustrate the process of completely filling and ejecting a magazine from loader 200. Note that FIGS. 6-9 use simplified drawings to demonstrate an exemplary loading process, and some components of loader 200 are not shown. However, any or all components described herein may be included in any embodiment that is constructed to perform this exemplary loading procedure. In FIG. 6, the initial state of loader 200 is shown, where empty magazine 220 is resting on the base of loader 200 proximate to a clip of ammunition 210. Ammunition 210 is located proximate to plate 410 and handle 240 is at rest. Magazine 220 of FIGS. 6-9 is shown as transparent for exemplary purposes. Magazine 220 is shown with a simplified feed mechanism for exemplary purposes, including spring 610 and follower 620.

Figure 7:
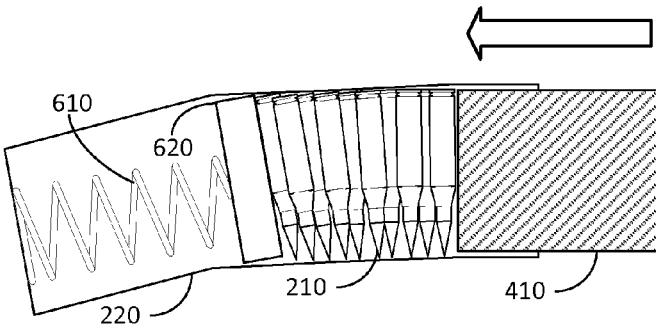
FIG. 7 is a top view of a magazine, ammunition, and a partial exemplary internal mechanism of an exemplary magazine loader.

In FIG. 7, plate 410 is fully motivated forward by gear 420 via shaft 430 and handle 240. As can be seen from this figure, a substantial portion of plate 410 is inserted into magazine 220, and all ten cartridges of ammunition 210 have been inserted into magazine 220 by the movement of plate 410. In an embodiment, a similar scenario may occur when a second clip of ammunition is inserted into magazine 220 when magazine 220 is configured receive three clips of ammunition 210.

Figure 8:
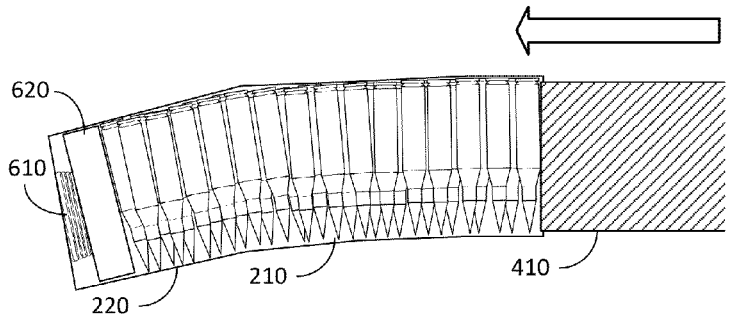
FIG. 8 is a top view of a magazine, ammunition, and a partial exemplary internal mechanism of an exemplary magazine loader.
Figure 9:
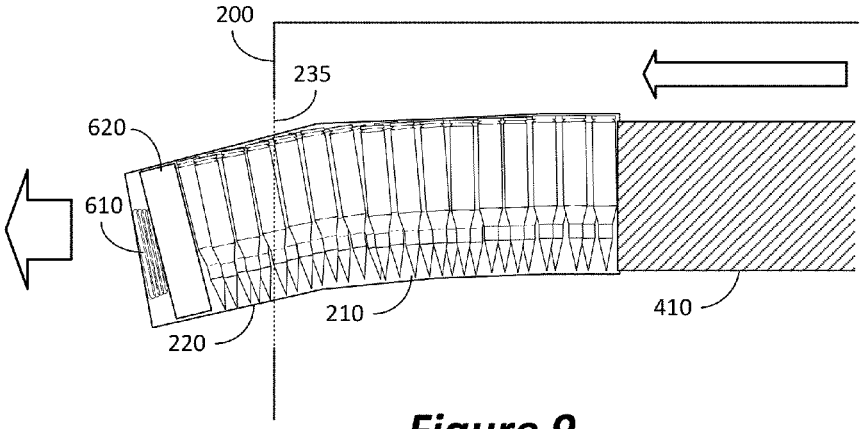
FIG. 9 is a top view of a magazine, ammunition, and a partial exemplary internal mechanism of an exemplary magazine loader.

In FIG. 8, the third and final clip of ammunition 210 has been fully inserted into magazine 220, but, as can be seen in the figure, magazine 220 is filled to capacity, and there is no room in the magazine for plate 410 it enter any further. In this case, the remaining force motivating plate 410 forward will push magazine 220 forward. When sufficient force is applied to handle 240, plate 410 may fully eject magazine 220 from loader 200, in an embodiment, through opening 235, as seen in FIG. 9. In an embodiment, upon return of plate 410 to its original position, (i.e., upon turning handle 240 in the opposite direction from the direction turned to insert cartridges into magazine 220, which, in an embodiment may be clockwise) the space in which magazine 220 was located will be empty, allowing another magazine to fall into that space and facilitating the loading of the next magazine.

FIGS. 10-14 illustrate a cross-sectional view of the internal mechanism of loader 200 according to an embodiment. Note that FIGS. 10-14 use simplified drawings to illustrate an exemplary loader mechanism, and some components of loader 200 are not shown. However, any or all components described herein may be included in any embodiment that is constructed with this exemplary mechanism. Note that the sizes and orientations of the components may be exaggerated or reduced in the figures for exemplary purposes, and any components that are capable of performing the disclosed functions of any size or type are contemplated as within the scope of the present disclosure.

Figure 10:
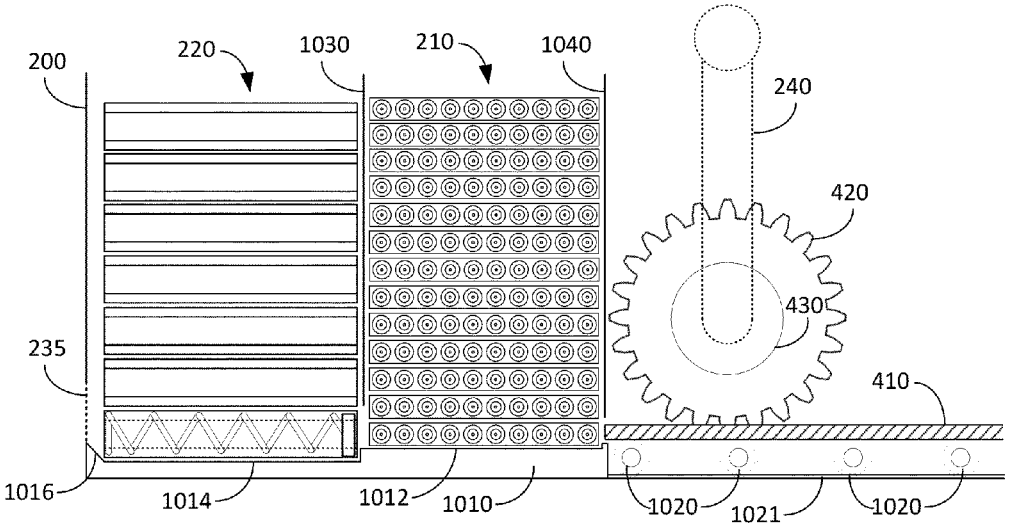
FIG. 10 is a side view of magazines, ammunitions, and an exemplary internal mechanism of an exemplary magazine loader.

FIG. 10 illustrates loader 200 containing magazines 220 and ammunition 210. Handle 240 is configured on loader 200, shown in dashed lines as handle 240 may be on the exterior of loader 200, while FIG. 10 primarily illustrates components located inside of the case of loader 200. In FIG. 10, handle 240 has not been actuated, and therefore all components of loader 200 are in a resting position. Gear 420 is affixed to handle 240 via shaft 430. In an embodiment, gear 420 may have teeth that engage with plate 410 so that gear 420 can motivate plate 410 towards ammunition 210 when gear 420 is rotated due to manipulation of handle 240. In order to keep plate 410 in its proper position while in motion, gears 1020 may be configured in loader 200. Gear 420 may be configured with teeth that may engage with indentations, holes, or other teeth configured on the bottom of plate 410 and with indentations, holes, or other teeth configured on track 1021. Note that gears 1020 may instead be configured on the top or one or more sides of plate 410. Note also that any other means or mechanisms may be used to keep plate 410 in its proper position for the purposes of the present disclosure. All such embodiments are contemplated as within the scope of the present disclosure.

Loader 200 may be constructed with internal base plate 1010. Base plate 1010 may be a separate and independent component of loader 200 that may be inserted or otherwise placed into loader 200 and may be affixed into loader 200 using any means. Alternatively, base plate 1010 may be an integral part of a case or housing of loader 200. Base plate 1010 may include ammunition section 1012 that may be constructed to support one or more clips or any other form of a particular ammunition type and quantity. Alternatively, ammunition section 1012 may be constructed to support multiple types or all types of ammunition in any configuration and quantity. Base plate 1010 may include magazine section 1014 that may be constructed to support one or more magazines of a particular type and quantity. Alternatively, magazine section 1014 may be constructed to support multiple types or all types of magazines in any configuration and quantity. Base plate 1010 may be constructed with lip 1016 that may facilitate the ejection of fully loaded magazines from loader 200. Any other means may be used to facilitate ejection of magazines from loader 200. All such embodiments are contemplated as within the scope of the present disclosure.

Internal wall 1030 may be configured in loader 200 to maintain physical separation of those magazines 220 that are not currently being loaded from ammunition 210. Internal wall 1040 may be configured in loader 200 to maintain physical separation of ammunition 210 that is not currently being loaded into a magazine from the internal mechanisms of loader 200.

Figure 11:
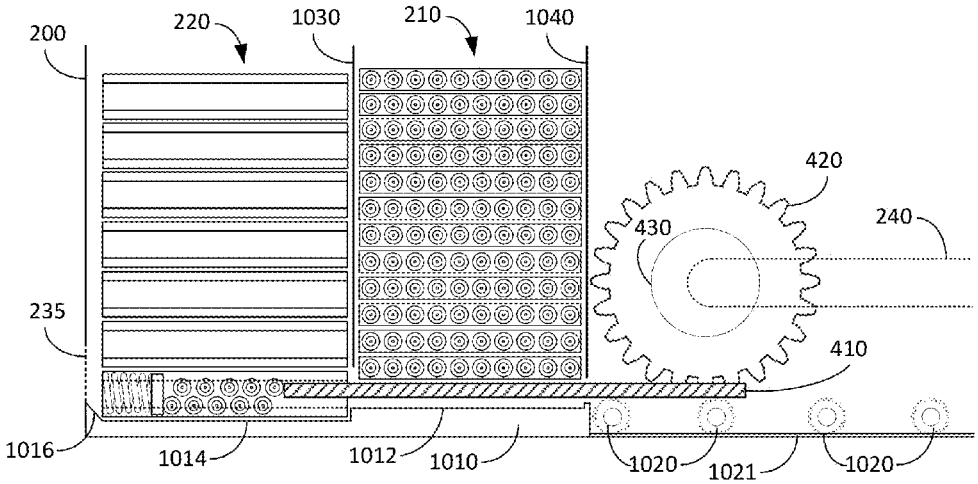
FIG. 11 is a side view of magazines, ammunitions, and an exemplary internal mechanism of an exemplary magazine loader.
Figure 12:
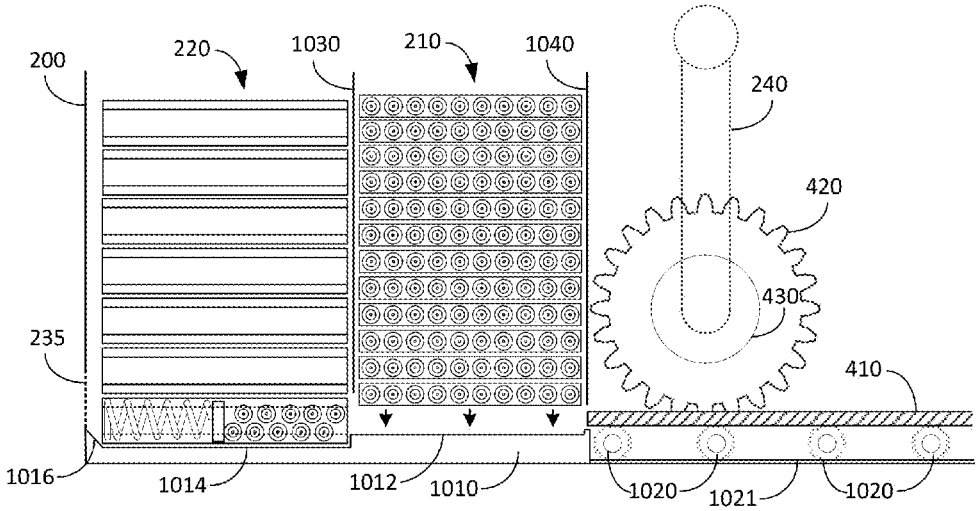
FIG. 12 is a side view of magazines, ammunitions, and an exemplary internal mechanism of an exemplary magazine loader.

FIG. 11 illustrates loader 200 after handle 240 has been manipulated, causing gear 420 to motivate plate 410 towards ammunition 210, inserting cartridges of ammunition 210 into magazine 220. As can be seen in the figure, plate 410 may extend into magazine 220. In FIG. 12, handle 240 has been returned to its original position, moving plate 410 back to a resting position, and allowing another clip or another quantity of ammunition 210 to drop onto ammunition section 1012.

Figure 13:
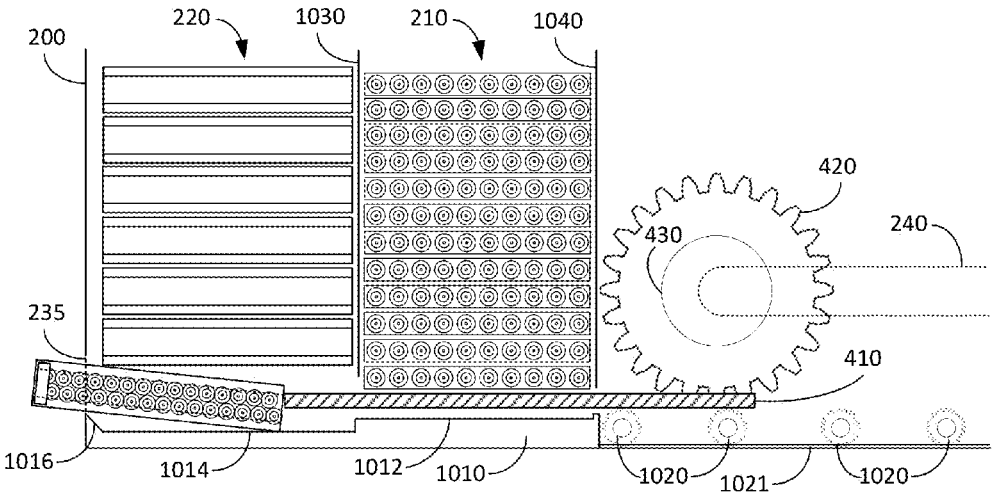
FIG. 13 is a side view of magazines, ammunitions, and an exemplary internal mechanism of an exemplary magazine loader.

FIG. 13 illustrates loader 200 after magazine 220 has been filled to capacity and after handle 240 has been manipulated to fully motivate plate 410 towards magazine 220. As can be seen in the figure, because ammunition 210 cannot be inserted any further into magazine 220 since magazine 220 is filled to capacity, plate 410 pushes magazine 220 towards and through opening 235, ejecting magazine 220 from loader 200. Lip 1016 may be constructed so that it provides enough resistance to retain magazine 220 in place at magazine section 1014 while cartridges are being loaded into magazine 220, but allows magazine 220 to be ejected when the force of plate 410 pushes against magazine 220 when magazine 220 is filled to capacity. Note that while magazine 220 is shown partially exiting loader 200 through opening 235 in FIG. 13, the force of plate 410 may be sufficient to fully eject magazine 220 from loader 200.

Figure 14:
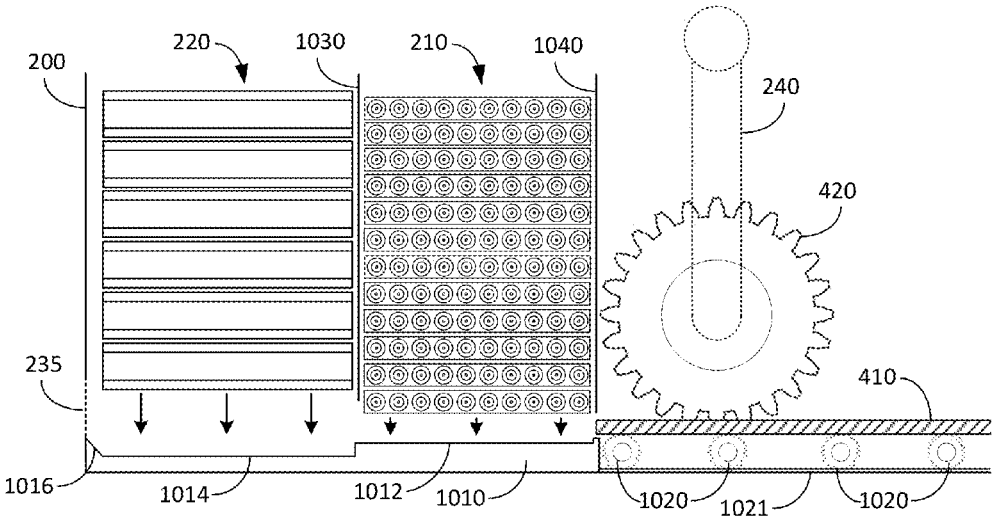
FIG. 14 is a side view of magazines, ammunitions, and an exemplary internal mechanism of an exemplary magazine loader.

Note also that the ability of plate 410 to eject magazines from loader 200 also provides for the ability of plate 410 to eject magazines that are improperly inserted into loader 200. For example, if magazine 220 is inserted into loader 200 backwards, such that the bottom (i.e., closed) end of the magazine is facing ammunition 210, plate 410 will simply propel the backwards magazine out of the loader FIG. 14 illustrates loader 200 after handle 240 has been returned to its original position following the ejection of one of magazines 220, allowing another clip or more of ammunition 210 to drop onto ammunition section 1012 and another magazine 220 to drop onto magazine section 1014, readying loader 200 to load another magazine 220. In an embodiment, loader 200 may now return to a configuration similar to that seen in FIG. 10.

Note that while the exemplary embodiments described herein and shown in the figures primarily described the present subject matter using horizontally aligned ammunition and magazines, one skilled in the art will appreciate how the present subject matter can be applied to construct a loader that loads magazines with vertically aligned magazines and ammunition. Note also that while in one embodiment, the components of the disclosed magazine loader may be constructed of metal, any of the components of the disclosed loader may be constructed of any suitable material or composite of materials, and any combination thereof.

The presently disclosed loader may comprise more than one loading mechanism and may be designed to load more than one magazine with each manipulation of a handle and/or the internal mechanisms of the loader. One skilled in the art will recognize how the presently disclosed load mechanism can be replicated within a single loader to enable the simultaneous loading of two or more magazines.

In an embodiment, the presently disclosed loader may be constructed to be of a particular size and shape that enables ease of transport. For example, a loader may be constructed to the same size as typical military ammunition containers, such as a 30 mm ammunition can. When constructed with a removable handle, such a loader may be integrated easily into existing military and law enforcement supply chains.

While the disclosed magazine loader has been described in connection with the various embodiments of the various figures, it is to be understood that other similar embodiments may be used or modifications and additions may be made to the described embodiments for performing the same function of magazine loading without deviating therefrom. Therefore, the disclosed magazine loader should not be limited to any single embodiment, but rather should be construed in breadth and scope in accordance with the appended claims.

What is claimed is:

1. A magazine loader comprising:

a case configured to simultaneously house a plurality of magazines and a plurality of ammunition units, each ammunition unit comprising a plurality of rounds of ammunition;

a handle affixed to a shaft that is operatively associated with a side of the case;

a gear affixed to the shaft;

a plate in a first position movably connected to the gear such that rotational motion of the gear linearly motivates the plate; and a base comprising an ammunition section proximate to the plate and a magazine section proximate to the ammunition section, wherein the ammunition section is configured to house an ammunition unit from among the plurality of ammunition units, and wherein the magazine section is configured to house a magazine from among the plurality of magazines;

wherein when the plate is motivated towards the ammunition section to a second position, the plate pushes an ammunition unit in the ammunition section into a magazine in the magazine section.

2. The magazine loader of claim 1, wherein the plate is motivated towards the ammunition section to the second position by manipulation of the handle in a first direction.

3. The magazine loader of claim 2, wherein the plate is motivated away from the ammunition section to the first position by manipulation of the handle in a second direction, permitting a second ammunition unit to enter the ammunition section.

4. The magazine loader of claim 1, wherein the case comprises a first opening for the insertion of the plurality of magazines.

5. The magazine loader of claim 1, wherein the case comprises a second opening for the insertion of the plurality of ammunition units of ammunition.

6. The magazine loader of claim 1, wherein when the plate pushes the ammunition unit in the ammunition section into the magazine in the magazine section, ammunition within the ammunition unit is removed from a clip.

7. The magazine loader of claim 1, wherein, when pushing the ammunition unit in the ammunition section into the magazine in the magazine section, the plate extends into the interior of the magazine.

8. The magazine loader of claim 7, wherein, when pushing the ammunition unit in the ammunition section into the magazine in the magazine section such that the magazine becomes filled to capacity, the plate pushes the magazine toward a third opening in the case.

9. The magazine loader of claim 8, wherein the plate at least partially ejects the magazine through the third opening in the case.

10. The magazine loader of claim 8, wherein the plate is motivated away from the ammunition section to the first position by manipulation of the handle in a second direction, permitting second ammunition unit to enter the ammunition section and a second magazine to enter the magazine section.

11. The magazine loader of claim 1, wherein the gear has teeth that engage openings in the plate.

12. The magazine loader of claim 1, wherein the plate has teeth that engage openings in the gear.

13. The magazine loader of claim 1, wherein the base comprises at least one gear that engages a bottom of the plate.

14. The magazine loader of claim 1, wherein the ammunition unit in the ammunition section and the magazine in the magazine section are horizontally oriented.

15. The magazine loader of claim 1, wherein the plurality of magazines and the plurality of ammunition units are vertically oriented.

16. A magazine loader comprising:

a case configured to simultaneously house a plurality of magazines and a plurality of ammunition units, each ammunition unit comprising a plurality of rounds of ammunition;

a mechanically actuated shaft movably associated with the case;

a gear affixed to the shaft;

a plate in a first position movably connected to the gear such that rotational motion of the gear linearly motivates the plate;

a base comprising an ammunition section proximate to the plate and a magazine section proximate to the ammunition section, wherein the ammunition section is configured to house an ammunition unit from among the plurality of ammunition units, and wherein the magazine section is configured to house a magazine from among the plurality of magazines;

wherein when the plate is motivated towards the ammunition section to a second position, the plate pushes an ammunition unit in the ammunition section into a magazine in the magazine section.

17. The magazine loader of claim 16, wherein the plate is motivated towards the ammunition section to the second position by actuation of the shaft in a first direction.

18. The magazine loader of claim 17, wherein the plate is motivated away from the ammunition section to the first position by actuation of the shaft in a second direction, permitting a second ammunition unit to enter the ammunition section.

19. The magazine loader of claim 16, wherein, when pushing the ammunition unit in the ammunition section into the magazine in the magazine section, the plate extends into the interior of the magazine.

20. The magazine loader of claim 19, wherein, when pushing the ammunition unit in the ammunition section into the magazine in the magazine section such that the magazine becomes filled to capacity, the plate pushes the magazine toward a third opening in the case.

* * * * *